United States Patent [19]

Kynast et al.

[11] Patent Number: 4,911,425

[45] Date of Patent: Mar. 27, 1990

[54] WHEELCHAIR USER EXERCISE DEVICE

[75] Inventors: Lutz T. Kynast, 1596 Adalia Pl., NE., Atlanta, Ga. 30329; Walter E. Langbein, Downers Grove, Ill.

[73] Assignee: Lutz T. Kynast, Atlanta, Ga.

[21] Appl. No.: 329,664

[22] Filed: Mar. 28, 1989

[51] Int. Cl.[4] ..... A63B 23/06

[52] U.S. Cl. ..... 272/69; 272/134

[58] Field of Search ..... 272/73, 69, 134; 73/117; 280/288.4, 304.1

[56] References Cited

U.S. PATENT DOCUMENTS

| | | | |
|---|---|---|---|
| 1,155,126 | 9/1915 | Bond | 73/117 |
| 2,749,747 | 5/1956 | Cline | 73/117 |
| 2,923,149 | 2/1960 | McMillian | 73/117 |
| 2,979,942 | 4/1961 | Allen | 73/117 |
| 3,180,138 | 4/1965 | Hundley | 73/117 |
| 3,643,943 | 2/1972 | Erwin, Jr. et al. | 272/73 X |
| 4,389,056 | 6/1983 | Tenniswood | 280/289 WC |
| 4,565,385 | 1/1986 | Morford | 280/289 WC |
| 4,765,614 | 8/1988 | Shute | 272/130 |
| 4,846,156 | 7/1989 | Kopnicky | 272/134 X |

FOREIGN PATENT DOCUMENTS

| | | | |
|---|---|---|---|
| 3304707 | 10/1983 | Fed. Rep. of Germany | 272/73 |
| 2226658 | 4/1973 | France | 73/117 |

*Primary Examiner*—Richard J. Apley

*Assistant Examiner*—H. Flaxman

*Attorney, Agent, or Firm*—Lee, Mann, Smith, McWilliams & Sweeney

[57] ABSTRACT

A manually operated wheelchair user exercise device comprising a pair of ramps each including an open front end and a barriered rear end, it being arranged so that their front ends extended in the same direction and are jointly tiltable between a downwardly inclined forwardly facing position and a level position, with the ramps at their respective rear ends each journaling a plurality of rollers that are flywheel effect equipped and that are spaced apart longitudinally of the respective ramps, which rollers are exposed at the top of the ramps, and including a manually operated mechanism for simultaneously tilting the ramps between a tilted wheelchair receiving position, in which the wheelchair user can back his chair onto the ramps while seated in the wheelchair, with the wheelchair rear wheels reaching and resting on the respective sets of ramp rollers, several of which are braked in the ramp tilted position, and the ramp level position, in which the wheelchair front wheels are braked and the wheelchair user can manually actuate the wheelchair rear wheels for exercise purposes. The rearmost of the respective sets of ramp rollers are equipped to provide independently adjustable resistance at the option of the user.

6 Claims, 7 Drawing Sheets

WHEELCHAIR USER EXERCISE DEVICE

This invention relates to a manually operated wheelchair user exercise device, and more particularly to an exercise device for wheelchair users that permits the wheelchair user, using his own wheelchair, and while sitting therein, to undergo exercise stress testing, rehabilitation, and/or aerobic training, development of cardiorespiratory fitness, and the like.

It is well known in exercise equipment for the development of fitness, such as bicycles, treadmills, free weights and weight machines (for example) has become widely used by the general public to follow proscribed fitness programs, for stress testing purposes, rehabilitation, and/or aerobic training, for instance. However, little attention has been given to the development of personal exercise equipment for those who are restricted to wheelchairs, even though persons whose primary mode of mobility is the manually operated wheelchair and such persons also have need for exercise, fitness training, and the like.

A principal object of the present invention is to provide a safe, durable and reliable, exerciser that is designed specifically for the user of a manually operated wheelchair to be able to exercise and test the functional capacity of his cardiorespiratory system, using his own wheelchair.

Another principal object of the invention is to provide an exerciser for those confined to a wheelchair, using his own wheelchair, as an inexpensive and reliable exerciser for stress testing, rehabilitation, and/or aerobic training that is operational in a relatively small or restricted space, and that permits the wheelchair user to exercise the upper portions of his body and arms in a fashion analaogous to normal manual wheelchair propulsion.

A further principal object of the invention is to provide an exerciser for use by those confined to a wheelchair, using his own wheelchair, to operate by himself for aerobic fitness training and with complete confidence and safety.

Yet another principal object of the invention is to provide an exerciser devised specifically for use by the wheelchair user, using his own wheelchair that can be located at the wheelchair user's home, and place of work, or at a health club or other fitness centers that tee wheelchair user participates in.

In accordance with the present invention, the exerciser comprises a pair of ramps each defining an open front end and a barriered rear end, with the ramps being arranged so that their front ends extend in the same direction, and the ramps being jointly tiltable between a downwardly directed forwardly facing position wherein the front ends of same are downwardly inclined for backing the user's wheelchair thereon, and a level position in which the ramps are substantially horizontally disposed, and the wheelchair is safely mounted for exercise use by the wheelchair user without leaving his chair. The exerciser ramps adjacent their rear ends journal a plurality of rollers that are in spaced apart relation longitudinally of the respective ramps and are disposed at the top of the respective ramps with the rollers being of the flywheel effect type, and those of such rollers short of the rearmost of the ramp rollers being braked when the ramps are in their tilted positions, and being free to rotate when the ramps are in their level position.

The respective ramps also each define a recess adjacent the front ends thereof for receiving a wheelchair front wheel on one side of the wheelchair, and for braking same when the ramps are disposed in their level position.

The exercise apparatus also includes means for simultaneously tilting the ramps between their indicated positions, for adjustably spacing the ramps to accommodate variant wheelchair wheel lateral spacing, and prevents separation or relative movement of the ramps when exercise is going on. The rearmost flywheel action roller of each ramp is also equipped to provide a manually variable resistance to exercise.

In use, when the exerciser ramps are disposed in their forwardly tilted positions, the user can manually back his wheelchair onto same and to the point where the rear wheels of the wheelchair engage the indicated ramp rollers, several of which are braked when the ramps are in their tilted position. When the ramps are shifted to their level position, and over the center of latching device holds the ramps in this position and the front wheels of the wheelchair are braked, which then permits the wheelchair user to exercise using the manual operations that are specific to wheelchair propulsion for stress testing, rehabilitation, and/or aerobic training purposes, adjusting the adjustable resistance mechanism involved with the rearmost roller of the respective ramps for purposes of changing the resistance involved, which is independent for each side of the exerciser.

Other objects, uses, or advantages, will be obvious or become apparent from a consideration of the following detailed description and the application drawings.

Figure 2:
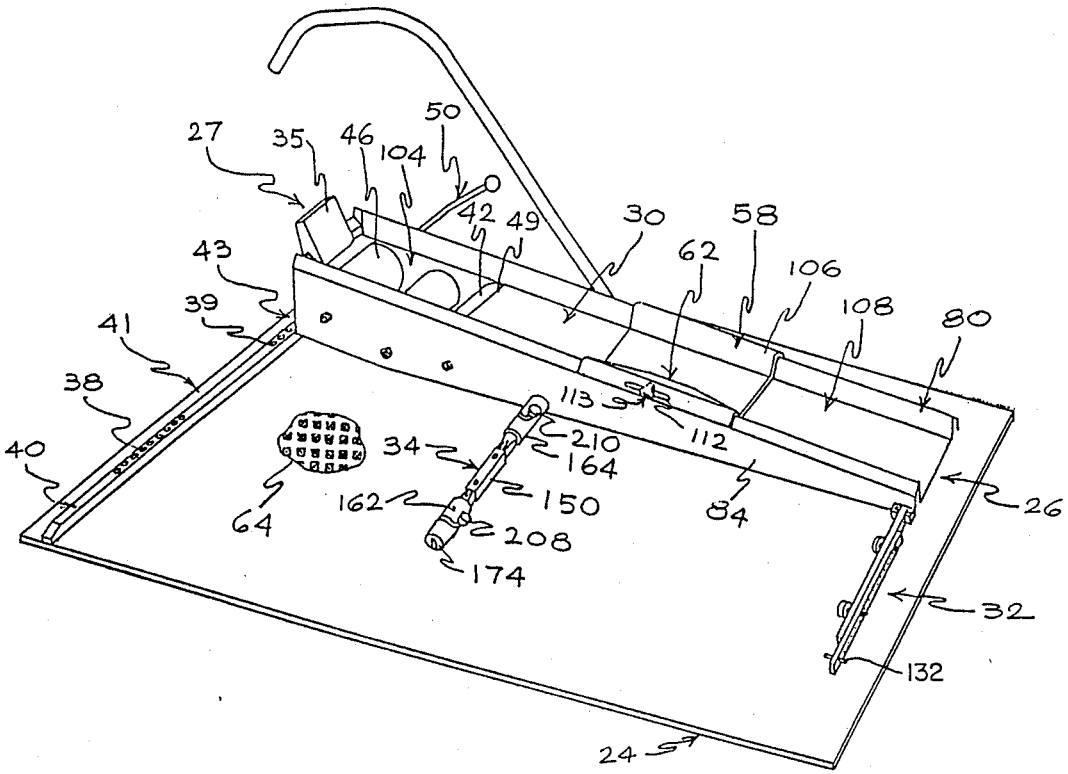
FIG. 2 is a view similar to that of FIG. 1, with one of the exerciser ramps omitted to better illustrate the extendable and contractable linkages that connect the ramps and the floor mat to which the ramps are applied in accordance with the present invention.
Figure 5:
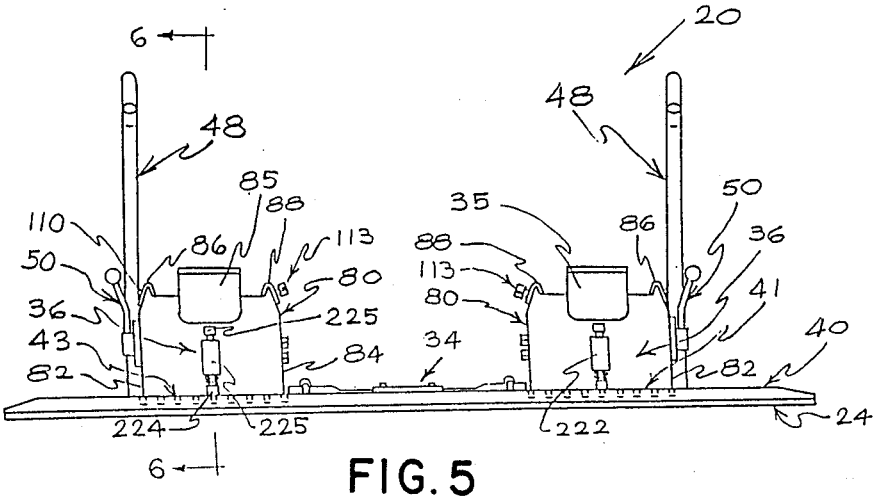
FIG. 5 is a rear end elevational view of the exerciser, taken substantially along line 5—5 of FIG. 3.
Figure 6:
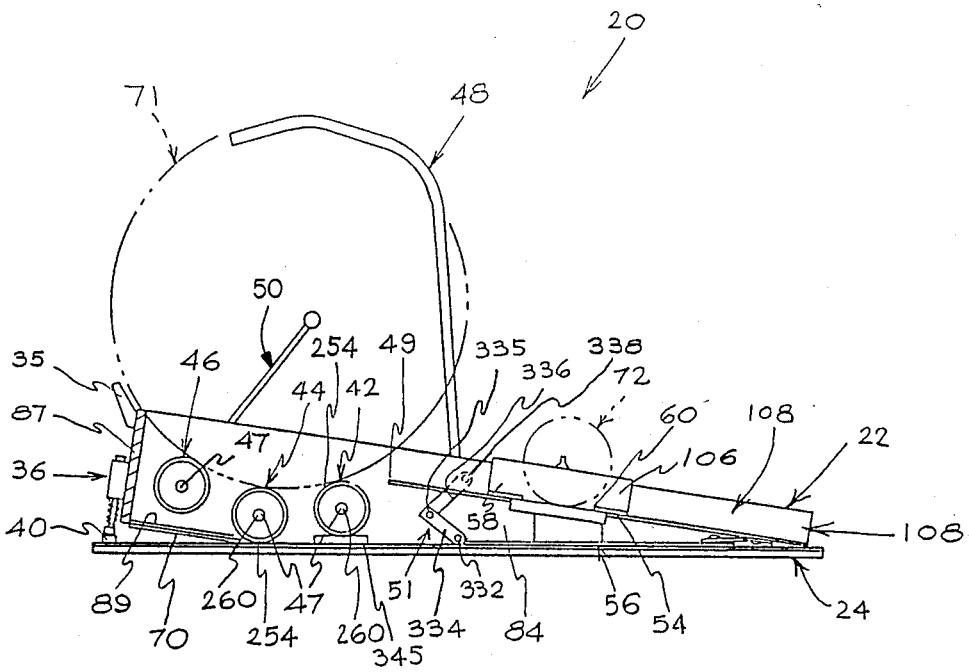
Figure 7:
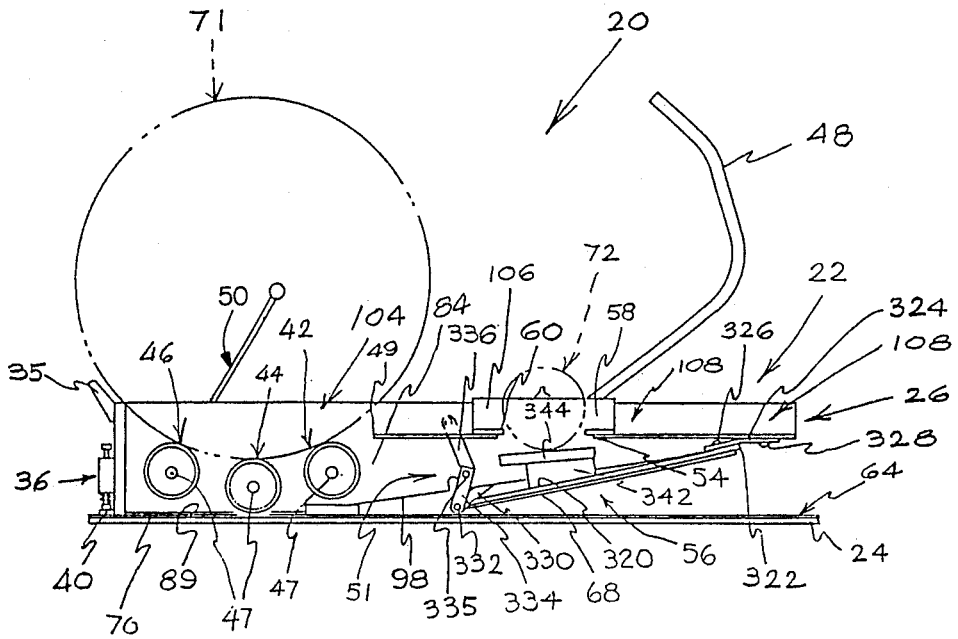
Figure 8:
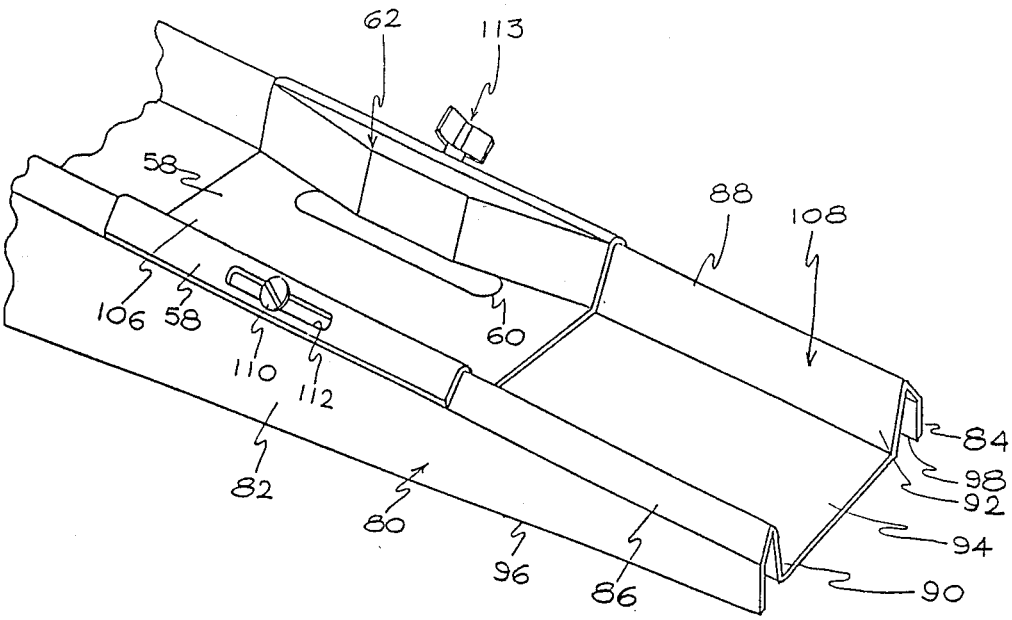
Figure 9:
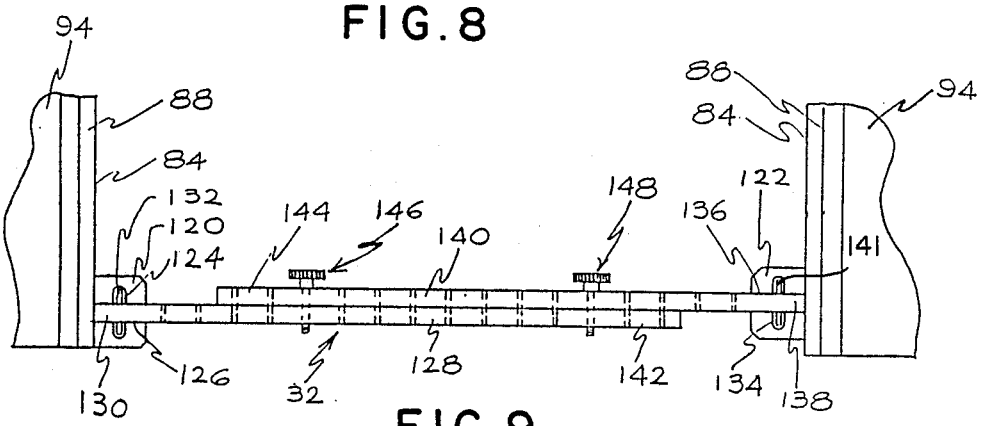
Figure 10:
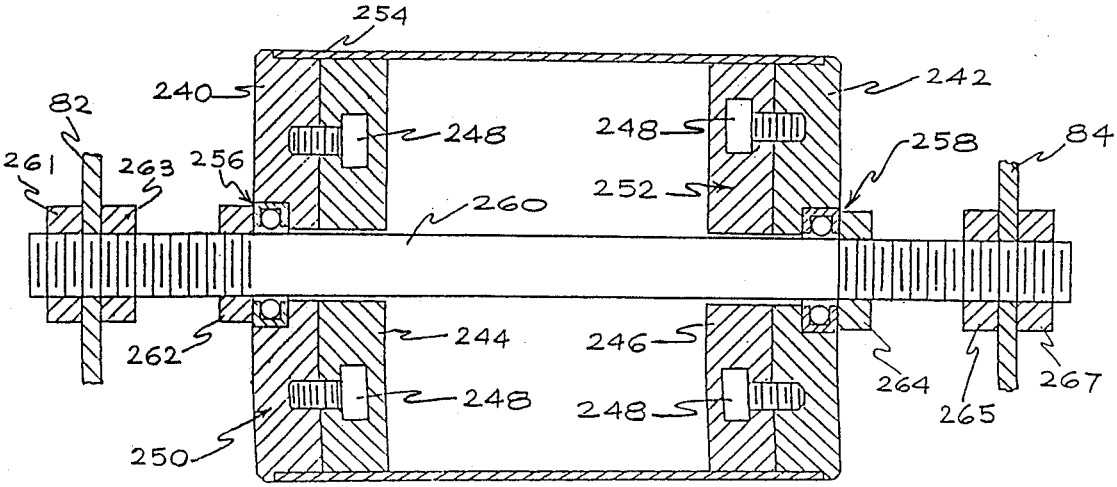
Figure 11:
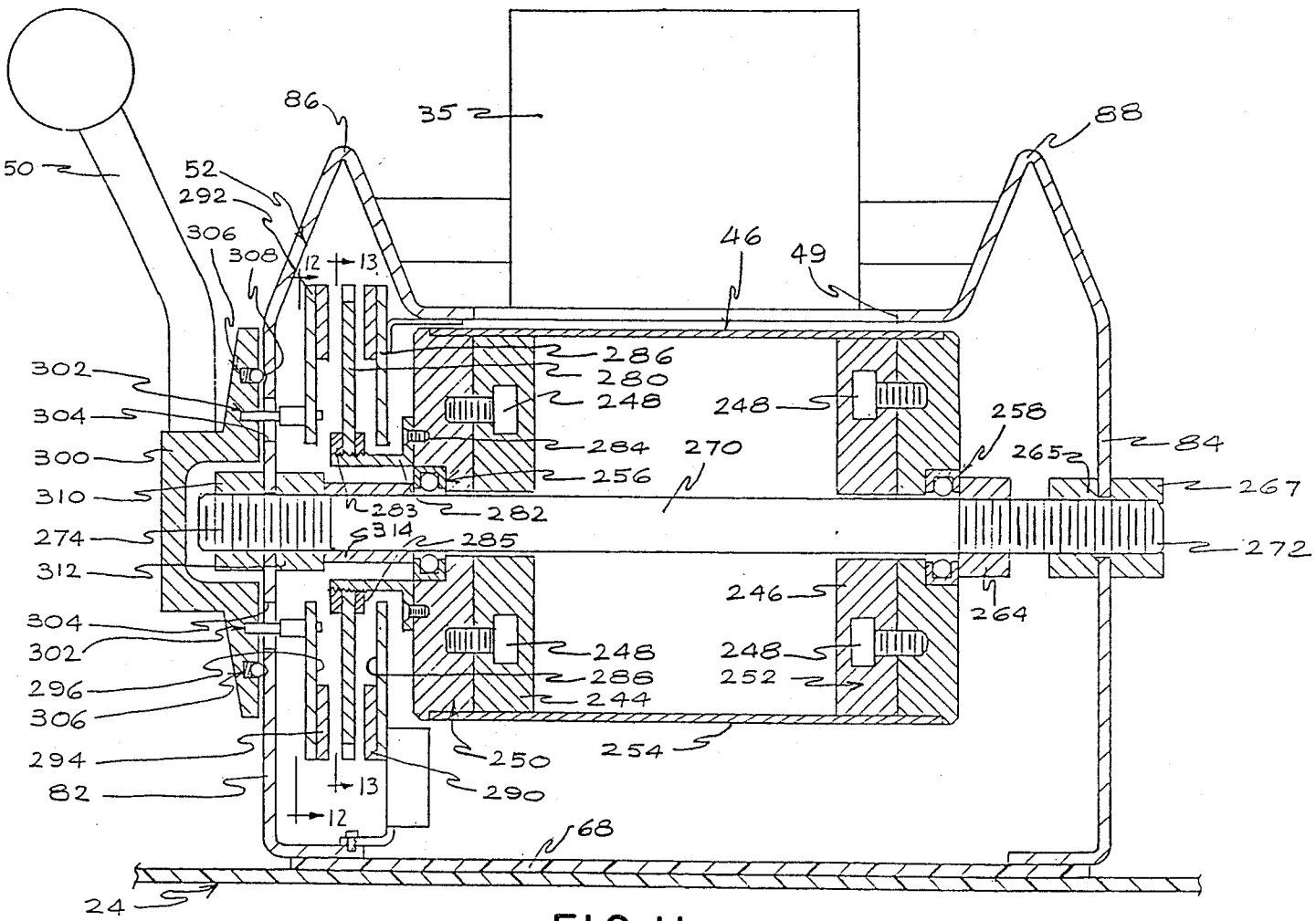
Figure 12:
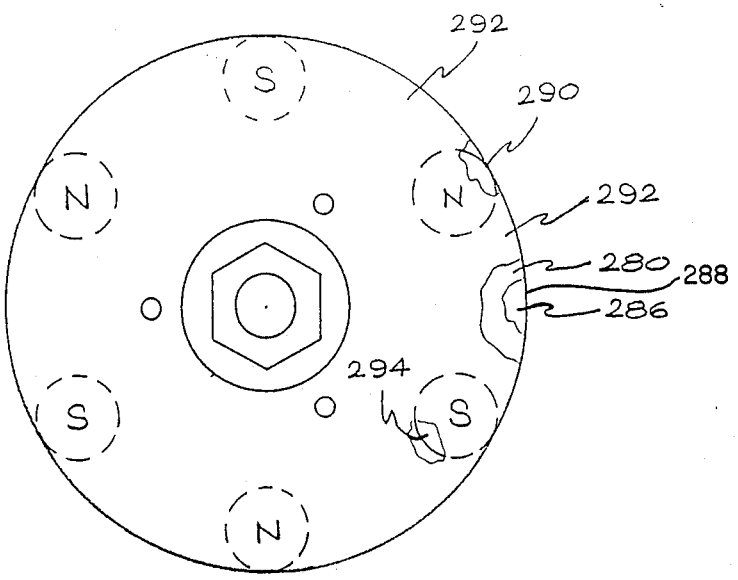
Figure 13:
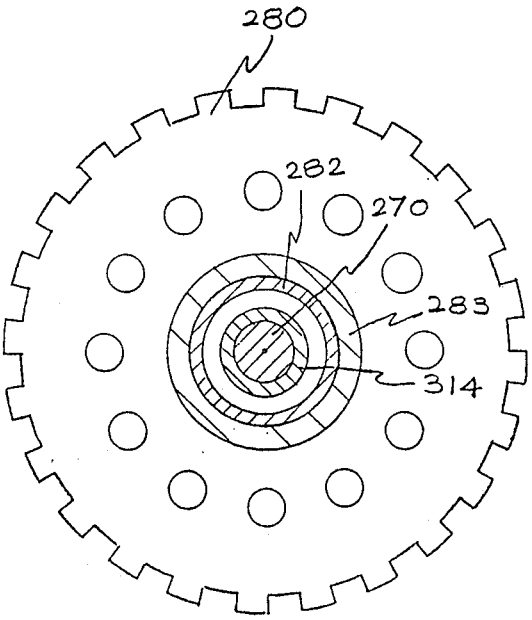
Figure 14:
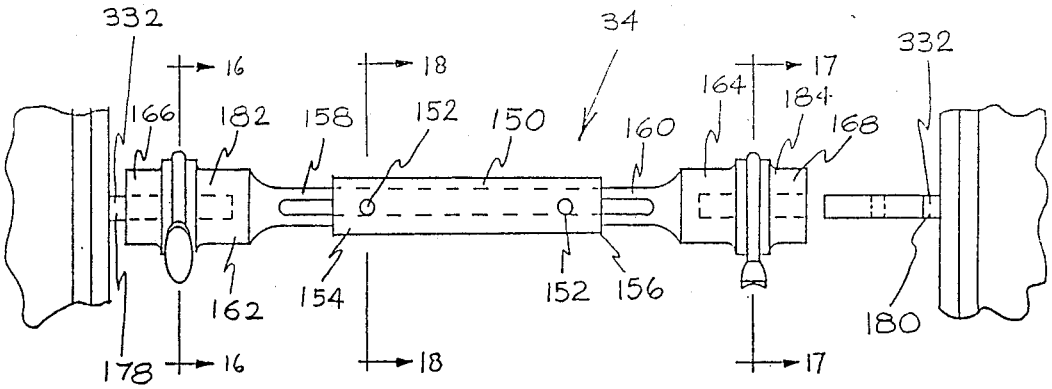
Figure 15:
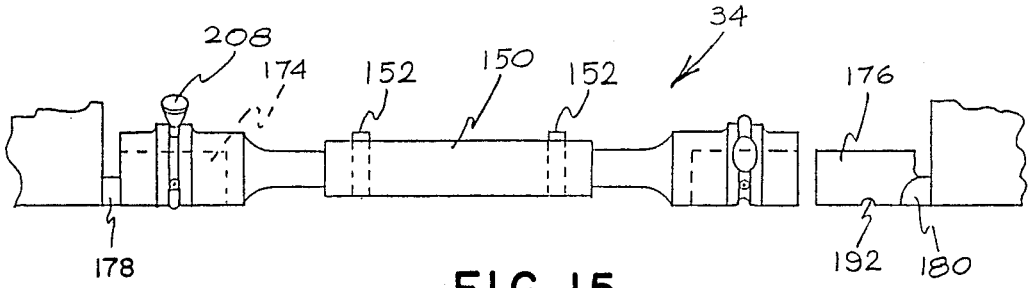
Figure 16:
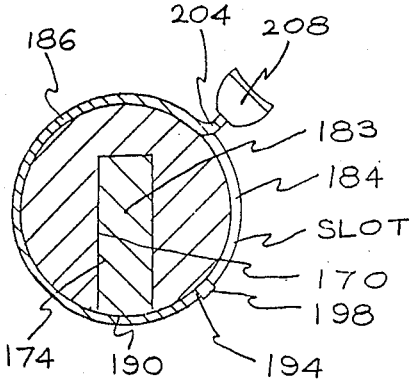
Figure 17:
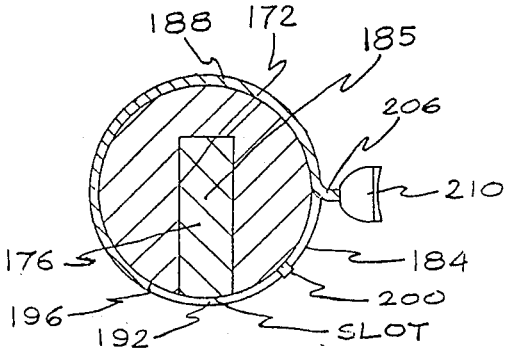
Figure 18:
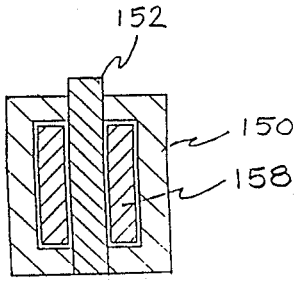

FIG. 6 is a diagrammatic sectional view taken substantially along line 6—6 of FIG. 5, showing the internal configurations of the respective ramps, the positioning of same when the respective ramps are in their tilted relations, and the location of the wheelchair rear and front wheels when the wheelchair is fully backed onto the exerciser, with the wheelchair wheels being indicated by the broken circular lines;

FIG. 7 is a view similar to that of FIG. 6, but illustrating the exerciser overcenter latch in the exerciser horizontal position, with the wheelchair disposed for exercise purposes, and the wheelchair front wheels being braked for that purpose;

FIG. 8 is a fragmental view of the forward portion of one of the exerciser ramps, illustrating on a larger scale details of construction;

FIG. 9 is a plan view of the adjustable linkage that connects the two ramps at their forward ends;

FIG. 10 is a sectional view through one of the resistance free rollers of the respective device ramps, illustrating the inertial flywheel effect components of such rollers;

FIG. 11 is a vertical sectional view through the rear end of one of the device ramps, showing in section the adjustable resistance roller thereof and the parts comprising same;

FIGS. 12 and 13 are plan views of component parts of the adjustable resistance device associated with the adjustable resistance roller of the respective device ramps;

FIG. 14 is a plan view of the central extensible and contractable linkage that adjustably separates the exerciser ramps, showing the adjustable linkage in plan that is illustrated in perspective in FIG. 2;

FIG. 15 is a side elevational view of the adjustable linkage arrangement shown in FIG. 14;

FIG. 16 is a sectional view taken substantially along line 16—16 of FIG. 14;

FIG. 17 is a sectional view taken substantially along line 17—17 of FIG. 14;

FIG. 18 is a sectional view taken substantially along line 18—18 of FIG. 14;

FIG. 19 is a fragmental plan view of the exerciser floor mat on an enlarged scale;

FIG. 20 is a view taken substantially along line 20—20 of FIG. 19, showing also a mat segment that each ramp of the exerciser device in question is equipped with in spaced relation with the floor mat; and FIG. 21 is a view taken substantially along line 21—21 of FIG. 19, showing the mat segment and the exerciser floor mat in the interlocking relation that is contemplated by the present invention.

However, it is to be distinctly understood that the specific drawing illustrations provided are supplied primarily to comply with the requirements of the Patent Laws, and that the invention is susceptible of modifications and variations that will be obvious to those skilled in the art, and which are intended o be covered by the appended claims.

GENERAL DESCRIPTION

Reference numeral 20 generally indicates the wheelchair user or exerciser of the present invention, which comprises a pair of ramps 22 on which the user's wheelchair may be backed from the front end 25 of the exerciser to the back end 27 of the exerciser.

The respective ramps 22 each define an open front end 26 and a barriered rear end 28, and a rampway 30 extending therebetween along which the wheelchair is backed for loading purposes and moved forwardly for unloading purposes, as will be disclosed hereinafter.

The ramps 22 are connected together laterally thereof for adjustment of the spacing therebetween by adjustable front linkage 32 and adjustable center linkage 34.

Each ramp at its rear end 28 includes a suitable rear stop or barrier member 35 and a spring biased latch device 36 (see FIG. 5) that cooperates with the apertures 38 and 39, respectively, which are formed in the respective groups 41 and 43 of the latch bar 40 that is suitably affixed to the floor mat 24 (as by using rivets or the like).

Figure 3:
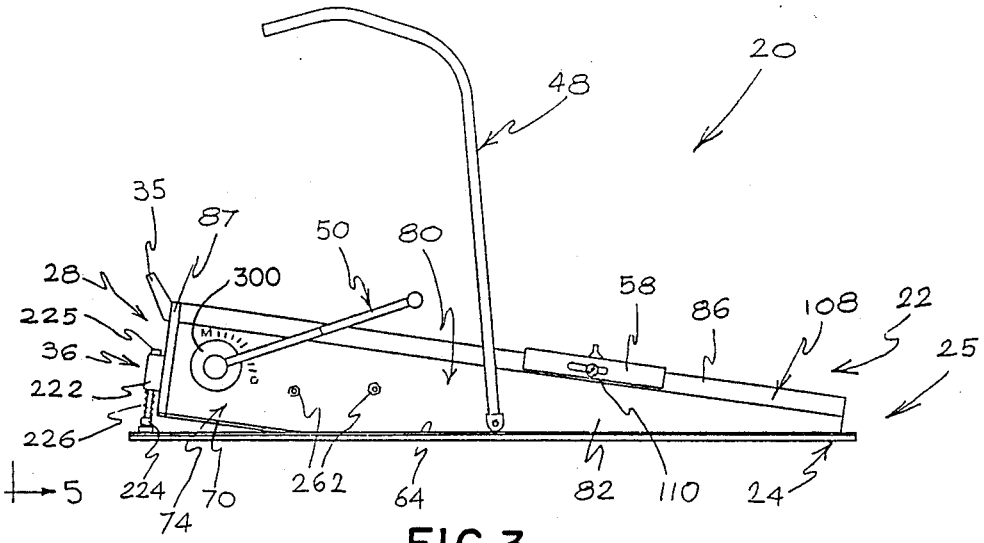
FIG. 3 is a side elevational view of the exerciser shown resting on its floor mat and disposed in its forwardly and downwardly inclined position in which it is disposed to receive a wheelchair backed rearwardly onto same from the right hand side of FIG. 3.
Figure 4:
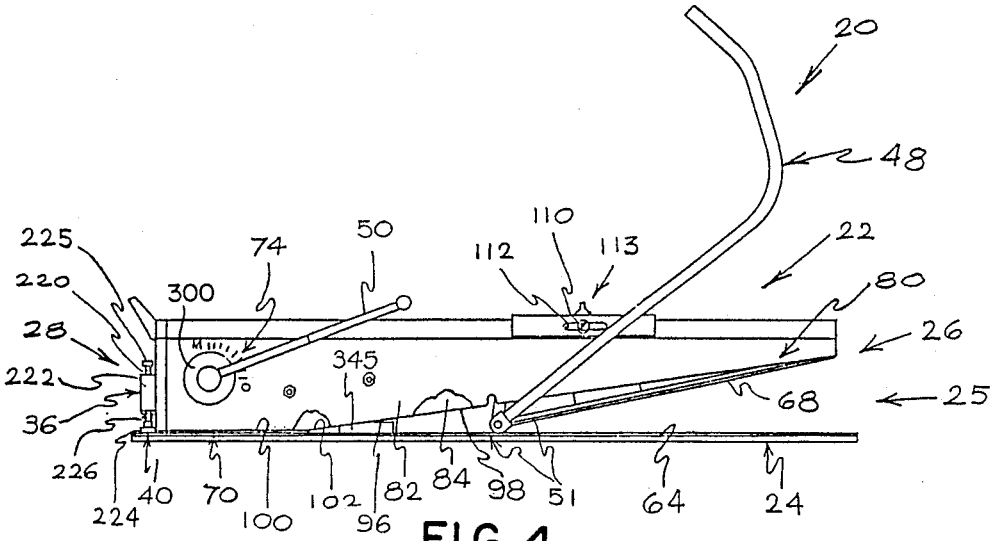
FIG. 4 is similar to that of FIG. 3, but shows the exerciser ramps disposed in their level position in which the exerciser and the wheelchair carried by same are in effect locked in position for exercise functioning of the exerciser.

In accordance with the invention, the ramps 22 are tilted simultaneously between the downwardly inclined wheelchair loading position of FIGS. 3 and 6 and the wheelchair user exercising position of FIGS. 4 and 7. Both ramps 22 adjacent their rear ends 28 each journal rollers 42, 44, and 46, that are to rotate about substantially horizontal axes 47 that extend generally transversely of the respective rampways 30, and that are exposed at the rear end of the respective ramps by the respective apertures 49 formed in the ramps adjacent their rear ends to open their respective ramps to the rollers 42, 44 and 46 at the top of the respective ramps adjacent the rear ends thereof, or receiving the wheelchair rear wheels when the wheelchair user backs his wheelchair onto the device 20 in accordance with the invention for exercising purposes.

Further in accordance with the invention, the respective ramps 22 are moved between the loading and exercising positions that have been indicated using the respective handles 48 that in accordance with the invention act together through the self locking leveling linkage mechanisms 51 of the respective ramps 22 (see FIGS. 6 and 7), and the center adjustable linkage devices 34 for moving the respective ramps simultaneously between the two basic positions that are indicated in FIGS. 3 an 6, and 4 and 7, respectively.

The rearmost roller 46 of the respective ramps 22 is arranged to provide user controlled variable resistance, with the user shifting in the respective handles 50 for this purpose. The respective handles 50 independently position the respective variable resistance loading devices 52 of the respective ramps 22 (see FIGS. 11–13) of which the rearmost rollers 46 are a part involves a conventional magnetic arrangement in the form of an aluminum disc spinning in an inhomgeneous magnetic field created by rays of permanent magnets disposed adjacent the disc surface as will be disclosed specifically hereinafter. Faraday's Law of electromagnetic induction predicts that any eddy currents that are induced in the movingdisc, and the motion opposing forces resulting from these induced currents are a consequence of Lorentz force law, with the motion resisting force being varied by changing the relative positions of the magnets thus altering the strength of the magnetic field involved (see for instance, the article by H. D. Wiederick et al. entitled Magnetic Braking: Simple Theory And Experiment, 1987, in American Journal of Physics, Vol. 55, pp. 500–503).

When the ramps 22 are in the loading position of FIGS. 3 and 6, the rollers 42 and 44 are suitably braked against rotational movement by engagement with the floor mat 24 or a brake pad secured thereto. The respective ramps 22, define in their respective rampways 30 the respective apertures 54 under which are respectively mounted the respective wheelchair front wheel braking devices 56 that are inoperative for braking purposes in the wheelchair loading position of the device 30, but that are shifted to both receive and brake the wheelchair front wheels in the exercising position of the device 20 (see FIG. 7). Operably associated with the rampway apertures 54 are the respective adjustable plates 58 that are shaped to conform to the shape of the respective rampways 30, and are each also formed to define an aperture 60 that are respectively aligned with the respective ramp apertures 54. The respective plates 58 are suitably releasably secured against movement longitudinally of the respective rampways 30, and are each provided with the respective spacers 62, for adapting the device 20 to accommodate variant wheelchair front wheel widths, and are arranged to be removed and replaced by similar spacers of variant thicknesses to accommodate the different wheelchair front wheel widths as hereinafter disclosed.

As indicated in FIGS. 19–21, the exposed surfacing 64 of the floor mat 24 cooperates with similar surfacing 66 of mat segments 68 and 70 that are affixed to the respective forward and rearward ends of the respective ramps 22 to interlock these components together in use, once the respective ramps 22 have been adjusted to receive a particular wheelchair. This is done by forming the floor mat surfacing 64 and the corresponding surfacings 66 of the respective mat segments 68 and 70 with the protuberance surfacing indicated in FIGS. 19–20 whereby the surfacings 64 and 66 involved define a multitude of spaced apart protuberances of essentially the same size and pyramedic configuration.

Figure 1:
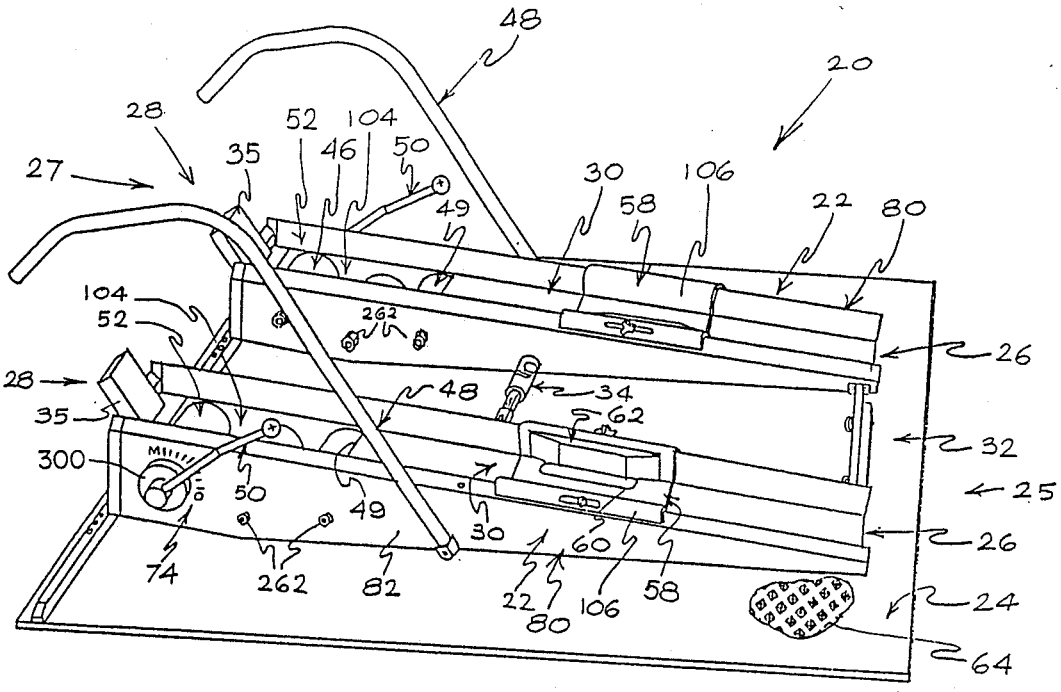
FIG. 1 is a diagrammatic perspective view illustrating one embodiment of the invention, with the view being taken from one side of the exerciser, and showing parts fragmentally and schematically.

It will thus be seen that in accordance with the invention, the ramps 22 of the exercise device 20 are adapted for adjustment to accommodate the wheel spacing of the wheelchair user's wheelchair wheels both laterally of the wheelchair, and longitudinally of same, as well as thickness of the front wheels. When the wheelchair user is to use a particular exercising device 20, the device 20 can thus be set to properly accept the wheelchair wheels. For this purpose, the adjustable linkages 32 and 34 may be lengthwise adjusted to appropriately space the respective ramps 22 laterally of each other, with the ramps 22 then being placed on the floor mat 24, and in particular its surfacing 64, with the ramp rear latching devices 36 appropriately applied to the nearest aperture 30 and 38 of the respective sets of apertures 41 and 43 to lock the ramps 22 to the floor mat 24; in this connection, the engagement of the floor mat surfacing 64 with the ramp mat segment 68 surfacing 66 insures stability (assuming the ramps 22, and specifically their handles 48, are positioned as indicated in FIGS. 1, 3, and 6 to dispose the ramps 22 in their forwardly and downwardly inclined positions shown in those figures with the front ends 26 thereof facing the front 25 of the exerciser 20). The slide plates 58 are appropriately positioned to locate the respective apertures 60 relative to the respective ramp apertures 54, lengthwise of the respective rampways 30, to drop the wheelchair front wheels for braking relation when the wheelchair is applied to the device 20 and the ramp level positioning is switched to. The spacers 62 or the substitutes therefor are removably applied to the respective slide plates 58 to hold the wheelchair front wheels from sidewise shifting during exercise use of the device 20, and thus the spacer 62 employed will depend on the width of the front wheels of the wheelchair user who will be using the device 20.

When the wheelchair user desires to use the device 20 for exercise purposes, assuming the ramps 22 and the ramp position keying handles 48 are disposed substantially as indicated in FIGS. 1, 3 and 6, the wheelchair user, sitting in his wheelchair, backs his wheelchair onto the ramps 2 and along the respective rampways 30, until the rear wheels of his wheelchair seat on rollers 42, 44, and 46, that are exposed at the respective ramp apertures 49. In this connection, for the loading position of the ramps 22 both the rollers 42 and 44 are disposed to be fully braked, as indicated. The respective rear stops 35 preclude further backing movement of the wheelchair with respect to the exercise device 20. This positioning of the wheelchair on the device 20 should dispose the wheelchair front wheels in alignment with the respective apertures 60 of plates 58; when mounted, the plates 58 and the spacer 62 are adjusted as needed to effect this result.

The wheelchair user then manually rocks one or both of the handles 48 forwardly of the exercise device 20, to approximately the position indicated in FIGS. 4 and 7, which results in the respective ramps 22 being essentially horizontally disposed, the rollers 42 and 44 being lifted from their braking relation relative to the floor mat 24 or brake pad involved, and the socketing and braking of the respective wheelchair front wheels by braking devices 56.

In this connection, the wheelchair rear wheels are indicated by reference numeral 71 in FIGS. 6 and 7, while the wheelchair front wheels are indicated by reference numeral 72 in the same Figures, with these wheels being shown only diagrammatically and in broken lines, and the wheelchair chair itself omitted altogether.

With the ramps 22 positioned as shown in FIGS. 4 and 7, the wheelchair user (assuming he or she remains in the wheelchair) sets the adjustable loading deices 52 of the respective ramps 22 to provide the desired resistance, as by using hand levers 50 for this purpose, and positioning same relative to suitable scales, such as the scale 74 applied to the outwardly facing sides of the respective ramps 22, to set such devices 52 to provide the desired resistance, or to change the resistance as desired, it being here noted that that resistance providing devices 52 are independent of each other.

The wheelchair user may then exercise as desired or prescribed for the evaluation or rehabilitation, and development of fitness of persons whose primary mode of mobility is the manually operated wheelchair.

When the exercise has been completed, one or more of the operating handles 48 are gripped by the wheelchair user and shifted to return the ramps 22 to their downwardly inclined positions (see FIGS. 3 and 6), which permits the wheelchair user to readily remove his wheelchair from the device 20 by moving same forwardly or to the right of FIGS. 3 and 6.

THE EXERCISER RAMPS

The respective ramps 22 are preferably formed from the respective sheet metal components 80 to define spaced sidewalls 82 and 84 that respectively merge into the respective upstanding generally triangularly configured ridges 86 and 88; components 80 extend downwardly from the respective ridges 86 and 88 to form the respective rampway sidewalls 90 and 92 that in turn merge into the integral rampway floor 94. The ramp sidewalls 82 and 84 define the respective elongate rectilinear edgings 96 and 98 on which the respective ramps 22 rest on the floor mat 24 in the forwardly and downwardly inclined position of the ramps 22. At the rear or back end of the ramps 22, below the respective devices 52, the ramp forming sidewalls 82 and 84 define the respective rectilinear edges 100 and 102 that are in substantial parallelism with the rampways 30, on which the respective ramps 22 rest in the level position of the ramps 22, in which position the ramps 22 are essentially locked by the overcenter type linkage mechanism 51 that is actuated by the respective handles 48, which essentially form levers for actuating the mechanisms 51 through the center located adjusting linkage 34.

As indicated, the rampway floor 94 ends at aperture 49 to define the respective windows 104 and the respective ramps 22 that expose the respective rollers 42, 44, and 46. The ramps 22 each include a rear wall plate 87 and a rear floor plate 89, that is aligned with edges 100 and 102.

The slide plates 58 each comprise a sheetmetal component 106 that is configured to substantially complement the troughs 108 defined by the respective rampways 30, as well as the aforereferred to apertures 60. As already indicated, the ramp floors 94 are apertured as at 54 to expose the wheelchair front wheel braking device 56 of each ramp, with the slide plates 58 normally being centered on the apertures 54 and secured in place by appropriate hold down screw 110 applied to adjustment slot 112 of the slide plate 58 as well as to a suitable threaded opening formed in the ramp ridge 86. It is preferable that the ramp floor aperture 54 be larger than aperture 60, longitudinally of the respective rampways 30, so that the respective slide plates 58 may be adjusted longitudinally of the respective ramps 22 to accommodate variant spacings of wheelchair front and rear wheels longitudinally of the wheelchair as needed, such that the wheelchair front wheels will be seated in the slide plate aperture 60 when the wheelchair is backed into exercising position, the respective slide plates 58 being adjusted longitudinally of the respective ramps for this purpose as needed.

The invention further contemplates that the slide plates 58 may have applied thereto the respective spacers 62, which may be locked in mounted position using adjustment handle 113 having a stem that operates in a suitable slot formed in the respective ramp ridges 88 (longitudinally thereof) and extends into the spacer 62, for tightening of the spacer 62 in place. A indicated, sets of the spacers 62 may be provided in varying thickness depending on the width of the wheelchair front wheels. Where the wheelchair front wheels are of a width to be in close fitting but slip fit relation with the respective slide plate apertures 60, the spacer 62 may be omitted altogether.

THE EXERCISER ADJUSTABLE FRONT LINKAGE

At the front 25 of the device 20, lugs 120 and 122 are affixed (see FIG. 9), as by welding, in opposed relation to the respective ramp side walls 84. Lug 120 in the form shown in FIG. 9 is formed to provide cross aperture 124 and cross slot 126 for removably mounting bar 128 by slipping its end portion 130 in the cross slot 126 with a suitable lock pin 132 at the same time entering aperture 124. The lug 122 is similarly formed to define cross aperture 134 and cross slot 136 to slidably receive the end portion 138 of a second bar 140 with lock pin 141 of bar 140 entering aperture 134, for mounting of the bars 128 and 140 to have the main portions of such bars and their respective end portions 142 and 144 in overlapping relation, with the respective bars being suitably apertured and threaded to receive the threaded type locking implements 146, with the apertures involved being at suitable spaced distance apart, such as one inch to provide for reduction or extension of the front linkage 32 as needed to position the respective ramps 22 to accommodate the lateral spacing of a particular wheelchair wheel base.

THE CENTER ADJUSTABLE LINKAGE

FIGS. 14–18 illustrate the general nature of the center adjustable linkage 34 of the device 20, which is adjustable lengthwise thereof to effect the same adjustment as made in connection with the front adjustable linkage 32.

The linkage 34 comprises tubular member 150 having a pair of essentially parallel pins 152 disposed across the longitudinal axis of same adjacent the ends 154 and 156 thereof that receive the respective forked ends 158 and 160 of the respective extension members 162 and 164, the oppositely extending ends 166 and 168 of which are respectively formed to define the respective rectilinear configured slots 170 and 172 (see FIGS. 15–17) that slidably receive the respective flanged ends or extensions 174 and 176 of the respective cross pins 178 and 180 that form a part of the overcenter linkage 51.

The respective extension members 162 and 164 define cylindrical portions that are concentric with the longitudinal axes of the respective members 162 and 164, that respectively are formed to define arcuate peripheral slots 184 that are similarly concentric (relative to the longitudinal axes 183 and 185 of the respective members 164 and 164), and shiftably receive the respective arcuate locking members 18 and 188 that are also received in the respective marginal slots 190 and 192 of the respective flanged ends or extensions 174 and 176 (see, for instance, FIG. 16) when the members 86 an 88 are in the respective locking relations, whereby their terminal ends 194 and 196 abut the respective stop pins 198 and 200 that are fixedly mounted in the respective members 162 and 164 for this purpose. The respective members 186 and 188 are formed to define radially extending end portions 204 and 206, respectively, each of which is provided with a suitable manually gripable handle 208, 210, as indicated at FIGS. 16 and 17.

The pin extensions 174 and 176 of the respective pins 178 and 180 are locked within the respective slots 170 and 172 of the respective extension members 162 and 164 when the respective locking members 186 and 188 are in the position of FIG. 16; when they have been shifted to the position of FIG. 17, the pin extensions 174 and 176 may be separated from the respective members 162 and 164, as indicated in FIGS. 14 and 15.

The linkage 34 shown in FIGS. 14–15 may be formed from suitable metallic or plastic materials as desired, except for pins 178 and 180, which should be formed from steel because of the rotational thrust to be applied to them by handles 48. As will be apparent from the showing of FIGS. 14–18, while the adjustable linkage 34 may be adjusted lengthwise thereof to take on the setting made for linkage 32 with regard to the desired spacing between the ramps 20, the linkage 34 also may be rotationally motivated using the handles 48 to effect simultaneous operation of the handles 48 and the changing of the respective ramps between the positions indicated, for instance, in FIGS. 6 and 7.

THE EXERCISE REAR LATCH

As indicated in FIGS. 3, 5, 6 and 7, the rear latch devices 36 comprise, for each ramp 22, a pin 220 slidably received in a tubular lug structure 222 suitably affixed to the rear plate 87 of the respective ramps 22, with the pins 220 each including an enlarged head 224 between which and the respective lug structures are received a suitable helical compression spring 226. The heads 224 of pins 280 are formed with reduced extensions that fit in the respective apertures 38 and 39 of the latch bar 40 (see FIG. 2), depending on the positioning of the respective ramps relative to each other, as adjusted by the front and center linkages 32 and 34. The latch pins 220 are spring biased to shift from the position of FIG. 7 to the position of FIG.6, with the respective pins 220 remaining seated in the respective apertures 38 and 39, as the ramps 22 are moved between the positions indicated in FIGS. 6 and 7. Pins 220 each include a headed end 225 that seats against the respective lugs 222 in the exerciser wheelchair loading position of FIGS. 3 and 6.

THE RAMP REAR WHEEL SUPPORTING ROLLERS

The rollers 42, 44, and 46 of the respective ramps 22 are basically the same, though, as indicated, the rearmost roller 46 forms a part of the adjustable loading device 52. As illustrated in FIG. 10, the basic flywheel action roller arrangement involved includes a pair of end caps 240 and 242, formed from aluminum or the like, each bearing a balanced weight in the form of the respective lead discs 244 and 246 that are mutually weight balanced and resectively poured in place about locater bolts 248, in any suitable manner to provide equal and uniformly weighted composite disc units 250 and 252 that are suitably secured to the ends of cylinder shell 254 (formed from PVC or the like), and ar equipped with suitable ball bearing journaling devices 258 for journaling the respective resulting rollers on the respective mounting shafts 260, with the bearing devices 256 and 258 being secured in place employing appropriate nuts 262 and 254 applied to the journaling shaft 260, insofar as rollers 42 and 44 are concerned. The shafts 260 of the respective rollers 42 and 44 are suitably mounted in the ramp side walls 82 and 84, as by using suitable sets of fastening nuts 261, 263, and 265, 267, that are illustrated in FIG. 10.

THE ADJUSTABLE LOADING DEVICE 52

As indicated in FIG. 11 for the left hand ramp 22 (the right hand ramp is similarly arranged), the rearmost roller 46 comprises the composite discs 250 and 254 shown in FIG. 10 as well as the rim 254 to which they are applied and the roller journaling bearings 256 and 258, the latter being anchored by suitable nut 264 applied to journaling shaft 270 that is shown to have its end 272 anchored to the ramp side wall 84 by appropriate nuts 265 and 267, as in the case in connection with the rollers 42 and 44.

At the other end 274 of the journaling shaft 270 is mounted the adjustable loading device 52 in association with the ramp side wall 82.

The device 52 comprises a central disc 280 suitably fixed as by employing threaded clamping rings 283 and 285 to tubular hub 282 that is in turn fixed to the composite disc 250 concentrically thereof, as by employing suitable screws 284. Suitably affixed to the respective ramps 22 involved is stationary disc 286, that is concentric with the disc 280, and in the form shown, has fixed to its surface 288 six permanent magnets 290 that are disposed in equally spaced relation circumferentially of the disc 286 and have the alternate polarity indicated in FIG. 12. On the other side of the fixed disc 280 is a second movable disc 292 that is concentric with the discs 280 and 286, and has a second set of permanent magnets 294 fixed to its surfacing 29, that have the alternate polarity and circumferential spacing indicated in FIG. 12, with the disc 292 being anchored to the exterior disc 300 by suitable anchoring devices 302 that ride in arcuate slots 304 formed in the ramp side wall 82; the exterior disc 300 may be journaled in place employing suitable spring biased ball journaling devices 306 operating in arcuate recesses 308 formed in the inside surfacing of the ramp wall 82. The handles 50 for operating the respective devices 52 are suitably anchored to the respective exterior discs 300.

As indicated in FIGS. 1 and 3, the exterior surfacing of the ramp walls 82 may be formed with a suitable scale 74 that, in the form shown, is sixty degrees in length about the axis of rotation of the disc member 300 that is suitably subdivided to indicate when zero, intermediate, and maximum resistance is offered by the particular device 52 involved, depending on the positioning of the handle 50 relative to the scale 74. When the handle 50 of each ramp 22 is positioned to position the movable disc 292 thereof with respect to the stationary disc 286 such that the north pole magnets of the disc 292 are horizontally aligned with the south pole magnets of the disc 82, maximum resistance is offered, while when the north pole magnets are horizontally aligned with the north pole magnets of disc 286, axially of the journaling shaft 270, minimum resistance is offered.

The end 274 of the shaft 270 is fixed to the side wall 82 of the respective ramps 22 in any shitable manner as by appropriate nuts 310 and 312, with an appropriate sleeve 314 being employed between the nut 312 and the journaling bearing 256 to journal that end of the roller 46 on shaft 270.

The adjustable loading device 52 in and of itself, as indicated, is conventional, and similar to the magnetic load adjustment devices available on the Mag Turbo Trainer sold by Performance Bicycle Shop, Chapel Hill, North Carolina, and Bike Nashbar, Youngstown, Ohio, and the Minoura Trainer offered by the indicated Performance Bicycle Shop, as that Company's Mag Turbo Trainer.

THE RAMP POSITION CHANGING LINKAGE MECHANISM AND THE FRONT WHEEL BRAKE 56

Each ramp 22 at its forward end has a foot section 320 (see FIG. 7) movably mounted therein, as by having its end 322 anchored to the ramp forward end 26 by a flexible strip 324 secured in place by appropriate rivets 326 and 328 or the like (see FIG. 7), with the foot 320 of each ramp 22 being proportioned for total receipt within the ramp 22 and mounting on its bottom side one of the mat segments 68 that extends therealong in substantial coextensive relation therefor for interlocking relation of its textured surfacing 66 with the upwardly facing textured surfacing 64 of the floor mat 24. Suitably journaled at the end 330 of the foot 320 are the respective cross pins 178 and 180 (see FIG. 14) of the respective ramps 22, each of which has a cylindrical section 332 (see FIGS. 6 and 7) that has arms 334, of thrust linkage 51, suitably keyed thereto, with the thrust arms 334 being in turn pivotally connected, as at 335 to legs 336 that are in turn suitably pivotally connected, as at 338, to the respective walls 82 and 84 of the respective ramps 22. The respective handles 48 are appropriately keyed to the respective pin sections 332 so that movement of the handles 48 between the positions of FIGS. 6 and 7 moves the linkage 51 to the overcenter relation shown in FIG. 7 to raise and lock the respective ramps 22 in their horizontal positions.

Suitably mounted on the top of the foot 56 is pedestal 342 that carries brake member 344 which may be in the form of a rubberized block or the like. Similar blocks 345 (see FIG. 6) are suitably affixed to mat 24 to serve as brakes for the respective rollers 42 when the ramps 22 are in their wheelchair loading positions of FIGS. 3 and 6.

As previously indicated, each ramp 22 includes a rear end plate 87 and a short floor plate 89 (see FIG. 6) underlying the roller 46, with the latter having applied thereto the mat segment 70 bearing the textured surfacing 66.

When the ramps 22 are in the wheelchair loading position of FIGS. 1 and 3, the foot 320 of each ramp 22 is positioned to dispose the brake plate 344 substantially against the underside of the ramp floor 94 to close the aperture 54, and the mat segment 68 of the foot 320 rests with and interlocks with the floor mat surfacing 64. In the position of FIGS. 4 and 7, the action of the invention mechanism 51 through handles 48 effects leveling of the ramps 22 such that the foot mat segment 68 is raised well above the floor mat surfacing 64, with its surfacing 66, but the mat segment 70 at the rear of the respective ramps seats against the floor mat surfacing 64, with its surfacing 66 in interlocking relation thereto, for exercise positioning of the wheelchair.

It will thus be seen that the invention provides an exercise arrangement specifically adapted for use by those persons whose primary mode of mobility is a manually operated wheelchair, with the invention allowing the wheelchair occupying person to back his or her personal wheelchair into position on the device ramps 22 for exercise. The inertial loading of the ramp rollers 42, 46 and 48 provides an inertial effect that tends to keep the manually actuated wheelchair wheels turning during exercise, and the respective adjustable loading devices 52 of each ramp can be independently positioned to provide the desired loading at the ramp rear end.

The device 20 needs no further components for the individual wheelchair user to use for obtaining exercise by remaining in his own personal wheelchair, and the device is readily adjustable to set same to receive wheelchairs having variant wheel bases laterally of the wheelchair and in the direction of forward or reverse movement of the chair.

Thus, the resistance and speed of each wheelchair rear wheel may be manipulated independently depending on the user's objectives and physical abilities, the rehabilitation he desires to receive, etc. The Electronic tachometers can be routinely applied to the moving components involved to give the user continuous feedback relative to the speed, distance, and time of exercising.

The foregoing description and the drawings are given merely t explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. An exercise device for manually operated wheelchair users, said exercise device comprising:

a pair of right and left ramps each defining a rampway for respectively receiving the right and left front and rear wheels of a wheelchair with each ramp including an open front and a barriered rear end, said ramps being arranged so that they extend in the same direction, said ramps being jointly tiltable between a downwardly directed forwardly facing wheelchair loading and unloading position, wherein said front ends thereof are inclined downwardly, and at a level wheelchair user exercising position in which said ramps are substantially horizontally disposed, means for shifting said ramps toward and away from each other for respectively receiving thereon the right and left front and rear wheels of wheelchairs to accommodate variant lateral spacing of wheelchair right and left front and rear wheels, said ramps adjacent their rear ends journaling a plurality of flywheel effect providing rollers that are exposed from the upper sides of the respective ramps, that are in spaced relation longitudinally of the respective ramps, and that are vertically disposed to lodge the respective right and left rear wheels, in tractive relation thereagainst, of a wheelchair received on said ramps, said device including means for braking one of said plurality of said rollers when said ramps are in their tilted positions, and for freeing said braked rollers to rotate when said ramps are in their level positions, said ramps each defining a recess adjacent the front ends thereof for receiving the respective right and left front wheels of a wheelchair having its respective right and left rear wheels in said tractive relation with the respective rollers of said ramps, means for proportioning said ramp recesses to accommodate variant spacing of wheelchair right and left front wheels longitudinally of said ramps, respectively, said device further including:

means for simultaneously tilting said ramps between their said positions, end means cooperating with said recesses, respectively, for braking the respective right and left front wheels of a wheelchair when the wheelchair is received on said ramps and said ramps are in their said level positions, whereby, when said ramps are in their downwardly directed positions, a wheelchair user may back his wheelchair onto the respective ramps until the wheelchair right and left rear wheels respectively lodge in said tractive relation with the respective ramp rollers with the wheelchair right and left front wheels being positioned over said recesses of the respective ramps, and when said ramps are tilted to their level positions, the wheelchair respective right and left rear wheels may be freely manually rotated on said rollers of the respective ramps and the wheelchair respective right and left front wheels are braked for holding the wheelchair on the ramp for exercise by the wheelchair user.

2. The exerciser set forth in claim 1 wherein:

one of said rollers of the respective ramps includes means for providing variable resistance to rotation thereof, said variable resistance means of the respective ramps being adjustable independent of each other.

3. The exerciser device set forth in claim 1 wherein:

said means for tilting said ramps between their said positions comprises each ramp being equipped with a shiftable base member underlying said recess of the respective ramps and including said means for braking the respective wheelchair right and left front wheels, with each ramp including overcenter crank means for shifting said ramps between their said positions and locking said ramps in their level positions.

4. The exercise device set forth in claim 1 including:

a floor mat on which said ramps are disposed for shifting between their said positions, said ramps including mat segments mounted on the same at their front and rear ends and resting on said mat, said mat and said mat segments having their abutting surfaces formed to define interlocking protuberances for precluding shifting of said ramps relative to said mat.

5. The exerciser device set forth in claim 1 wherein:

each of said ramps includes an apertured plate member adjustably mounted on the respective ramps over the respective ramp recesses and comprising said proportioning means, with the aperture of the respective plate members being formed to pass the respective wheelchair right and left front wheels into the respective ramp recesses when a wheelchair is mounted on said ramps.

6. The exerciser device set forth in claim 5 wherein:

said plate members are respectively equipped adjacent the respective apertures with a spacer for accommodating variant wheelchair front wheel widths.

* * * * *